United States Patent [19]

Minks et al.

[11] 4,100,906

[45] Jul. 18, 1978

[54] PULSE GENERATOR FOR ENERGY DISCHARGE SYSTEM

[76] Inventors: Floyd M. Minks, Rte. 1, Box 66, Kissimmee, Fla. 32741; Floyd A. Minks, Box 252, Ridgetop, Tenn. 37152

[21] Appl. No.: 461,392

[22] Filed: Apr. 16, 1974

Related U.S. Application Data

[63] Continuation-in-part of Ser. No. 181,445, Sep. 17, 1971, Pat. No. 3,837,325.

[51] Int. Cl.[2] ..... F02P 5/04; F02P 1/00

[52] U.S. Cl. ..... 123/148 E; 123/146.5 A; 331/65; 315/209 T; 324/15

[58] Field of Search ..... 123/148 OCD, 148 E; 324/15; 331/65, 181, 170, 172; 315/209 T

[56] References Cited

U.S. PATENT DOCUMENTS

| | | | |
|---|---|---|---|
| 3,230,478 | 1/1966 | Page | 331/170 |
| 3,277,340 | 10/1966 | Jukes et al. | 123/148 E |
| 3,331,986 | 7/1967 | Hardin et al. | 123/148 E |
| 3,408,536 | 10/1968 | Tibbs | 123/148 E |
| 3,502,955 | 3/1970 | Minks | 331/181 |
| 3,593,696 | 7/1971 | Guido | 123/148 E |

*Primary Examiner*—Ronald B. Cox

*Attorney, Agent, or Firm*—Duchworth, Hobby & Allen

[57] ABSTRACT

This disclosure relates to a pulse generator for triggering successive energy discharges such as in automotive or other ignition systems and the like, which generator comprises a magnetic circuit a portion of which is interrupted by a conductive vane the position of which controls the production of the pulses and at least one winding encircling a portion of said magnetic circuit, means connecting said winding to the output of an amplifying means, said components connected to produce as negative feedback at the input of said amplifying means the total voltage across said winding; the magnetic circuit and electronic circuitry connected thereto being so arranged as to minimize the number of components which must be placed in close physical proximity to the rotating vane, generally in the distributor of the engine, and to also minimize the number of interconnecting leads from the vane location to the balance of the ignition system, thus producing a small, inexpensive and highly accurate pulse generator.

3 Claims, 2 Drawing Figures

PULSE GENERATOR FOR ENERGY DISCHARGE SYSTEM

PARENT APPLICATION DATA

This application is a continuation in part of Ser. No. 181,445, filed Sept. 17, 1971 and now U.S. Pat. No. 3,837,325.

BACKGROUND OF INVENTION

Application Ser. No. 181,445 of which this is a continuation in part, discloses a pulse generator circuit wherein the entire voltage across one winding of an oscillator circuit is used as negative feedback to prevent unwanted oscillation under specific conditions of coupling between windings in said oscillator. That circuitry allowed use of a generally U-shaped or C-shaped core with a vane interrupting this core structure at only one point. As pointed out in that application this offered considerable advantages over previous vane controlled oscillator circuits. The purpose of the present invention is to retain the advantages of that invention while at the same time reducing the number of non-grounded leads leading from the distributor (or the portion of the oscillator circuit required to be in the distributor) to one, while also eliminating all taps or intermediate connection points on windings within the distributor unit. In one embodiment of the present invention one winding is the only component required to be in the distributor. It is another object of this invention to further decrease the sensitivity of the circuitry to both input voltage and temperature. A thorough understanding of the concepts disclosed and described in U.S. Pat. No. 3,837,325 will be necessary for a proper understanding of what is to follow in this application since concepts disclosed and described therein will not be herein repeated.

In said previous application and in the previous patents refered to therein, the amplifying device has been biased in the active region at a constant current, generally produced by the combination of a resistor and the emitter circuit of the amplifying device and a reference voltage such as produced by a stabistor in the base circuit. In the present invention the equivalent amplifying device is operated as a constant voltage but variable current device. The collector emitter bias voltage is held at, or very near, the base emitter saturation voltage for the transistor (typically about seven tenths of a volt for a silicon device). Because of the low voltage, the dissipation in the amplifying device is held to a low level and satisfactory operation of the stage has been observed over a range of from one to forty volts DC supply voltage.

The invention will now be described with reference to FIGS. 1, 2 and 3 which are circuit diagrams of this portion of an ignition system.

Figure 1:
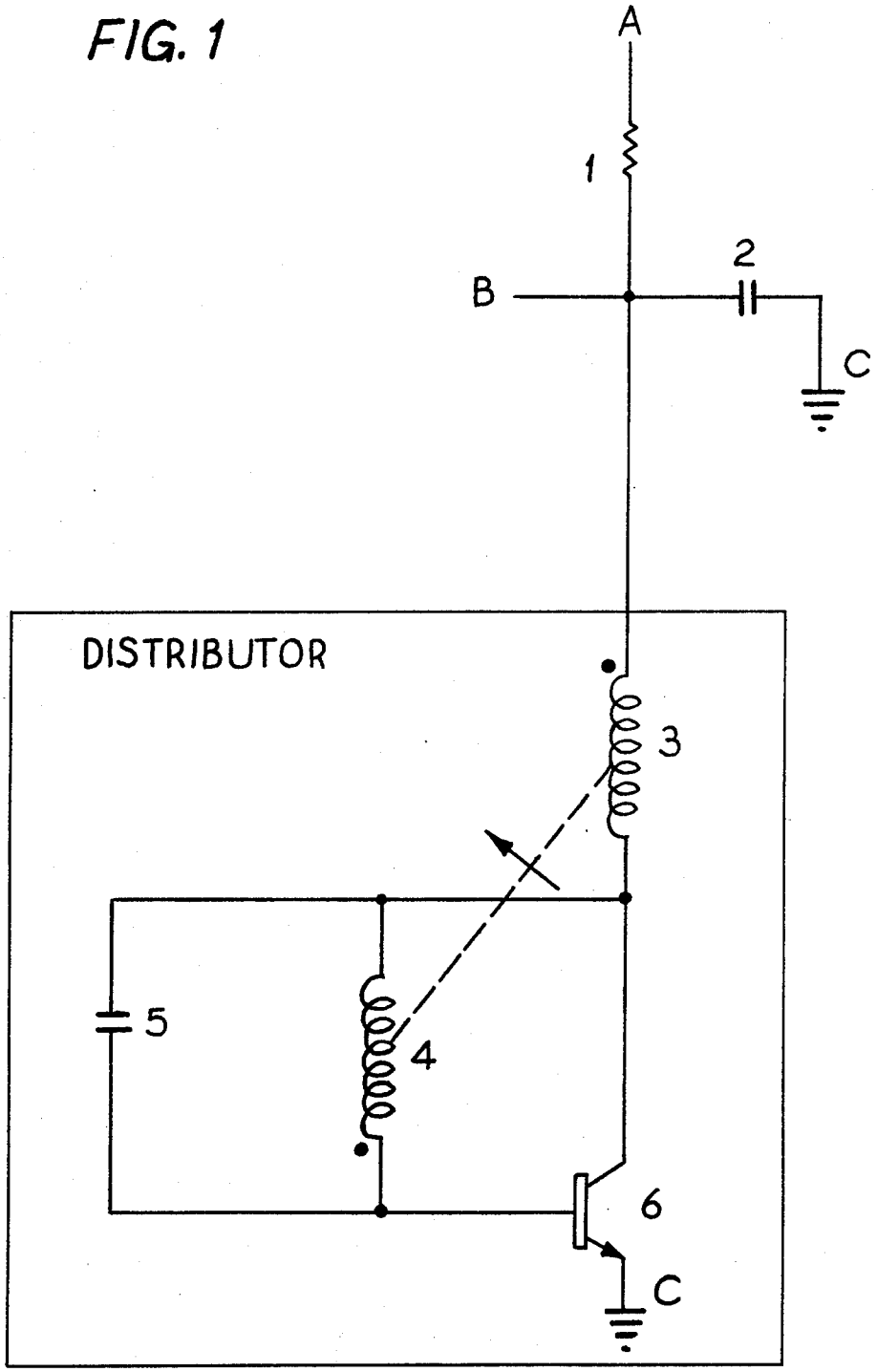

FIG. 1 shows only those electrical components associated with the first stage of the oscillator of the ignition system. Components 1 and 2 and junction points A, B and C are located in the housing with the remaining electronic components of the ignition system. Components 3, 4, 5 and 6 and common ground connection C are located adjacent to the rotating vane, probably in the distributor unit. A rotating vane, not shown, interrupts a portion of the magnetic flux coupling windings 3 and 4. Windings 3 and 4 may be typically wound and arranged on a core as are windings W1 and W2 in application Ser. No. 181,445 now U.S. Pat. No. 3,837,325. Winding 4 would contain generally more turns than winding 3, such that when the vane is so positioned that maximum coupling exists, a given voltage applied to winding 3 would produce a somewhat greater voltage across winding 4. The number of turns on winding 4 must be limited so that, when coupling is minimized between winding 3 and winding 4 by the position of the vane, a given voltage applied to winding 3 could produce a somewhat smaller voltage measured across winding 4. These measurements are to be made at the resonant frequency of the circuit which is determined primarily by the parallel resonance of winding 4 and capacitor 5. Number 6 represents a first amplifying device shown as a NPN transistor with its collector connected to the junction between windings 3 and 4, its base connected to the other end of winding 4 and its emitter connected to ground or reference point C. In the absence of oscillations or other alternating current signals, and neglecting the negligible DC impedance of winding 4 the base and collector of transistor 6 must be at the same potential, therefore the voltage from the collector to ground will equal the base emitter saturation voltage of the transistor which as is well known and described in the literature is relatively stable over a wide range of currents, temperature and transistor gain. (Typical temperature coefficient is $-2$ MV /° C.) Number 1 is a current limiting resistor connected at point A for connection to a source of positive voltage such as $+12$ volts from a vehicle battery (not shown), the negative terminal of which is connected to ground. The other end of resistor 1 is connected to junction point B, typical value of this component might be 1,000 ohms. Point B is connected through by-pass capacitor 2 to ground, typical value of this component being 0.05 MFD. Point B is also connected to the distributor and to the remainder of the ignition system. A DC level shift from approximately $+0.7$ volts to approximately $+0.2$ volts with respect to ground will occur at this point and the signal is used to control the balance of the ignition system. If necessary, both of these values may be increased by inserting a diode in series with winding 4. This type of signal because of both amplitude and temperature co-efficient is easily adapted to controlling a transistor in series with an inductive energy storage means such as a conventional spark coil. As has previously been described, if no oscillations exist, the voltage at the collector of transistor 6 and thus at point B because of the negligible DC or low frequency impedance of coil 3 will be base emitter saturation voltage of device 6. However, if oscillations particularly of a high amplitude exist, the average voltage at point B and for practical purposes, the only voltage, since high frequency components are by-passed by capacitor 2, will be greatly reduced. This phenomeon will not be described in great detail because it is well known, going as far back as class C radio frequency amplifiers where application of an input signal and tuning of the plate circuit would produce a drastic dip in plate current. In this case we see a reduction of average collector voltage. If infinite gain and input impedance is assumed for amplifying device 6, then oscillations will begin and cease as the vane passes the points where voltage transfer from coil 3 to coil 4 is unity. With readily available amplifying devices this is still very nearly true. This is so because the entire voltage induced across winding 3 is used as negative feedback; that it is effectively substracted from the voltage produced by coil 4. This can be seen as follows: the input to the device 6 in the common emitter mode is from the emitter to the base. Capacitor 2 is selected to have negligible impedance at the oscillation frequency. Therefore, both the emitter of 6 and point B are effectively connected to ground at that frequency. Therefore the voltage existing on the input or base of device 6 will be the voltage across coil 3 plus the voltage across coil 4. Note from the polarity marks shown, that these voltages are oppositely phased so that at any instant the AC voltage across coil 3 is subtracted from the voltage produced by coil 4. Thus the common connection of 3 and 4 at the collector, as shown, produces both the required negative feedback and the DC bias for device 6. The frequency that circuitry of this type operates at is limited only by the components available for its construction. If a ferrite core is used as shown in the previous applications typical frequencies may be from a few hundred kilocycles to a few megacycles, however, if device 6 has sufficient amplification in the range of several hundred megacycles the ferrite core may be completely eliminated and the coils 3 and 4 simply placed in air or on a non-magnetic mount adjacent to opposite sides of the rotating vane with practical oscillation frequencies being in the range from a few tens to a few hundreds of megacycles.

Figure 2:
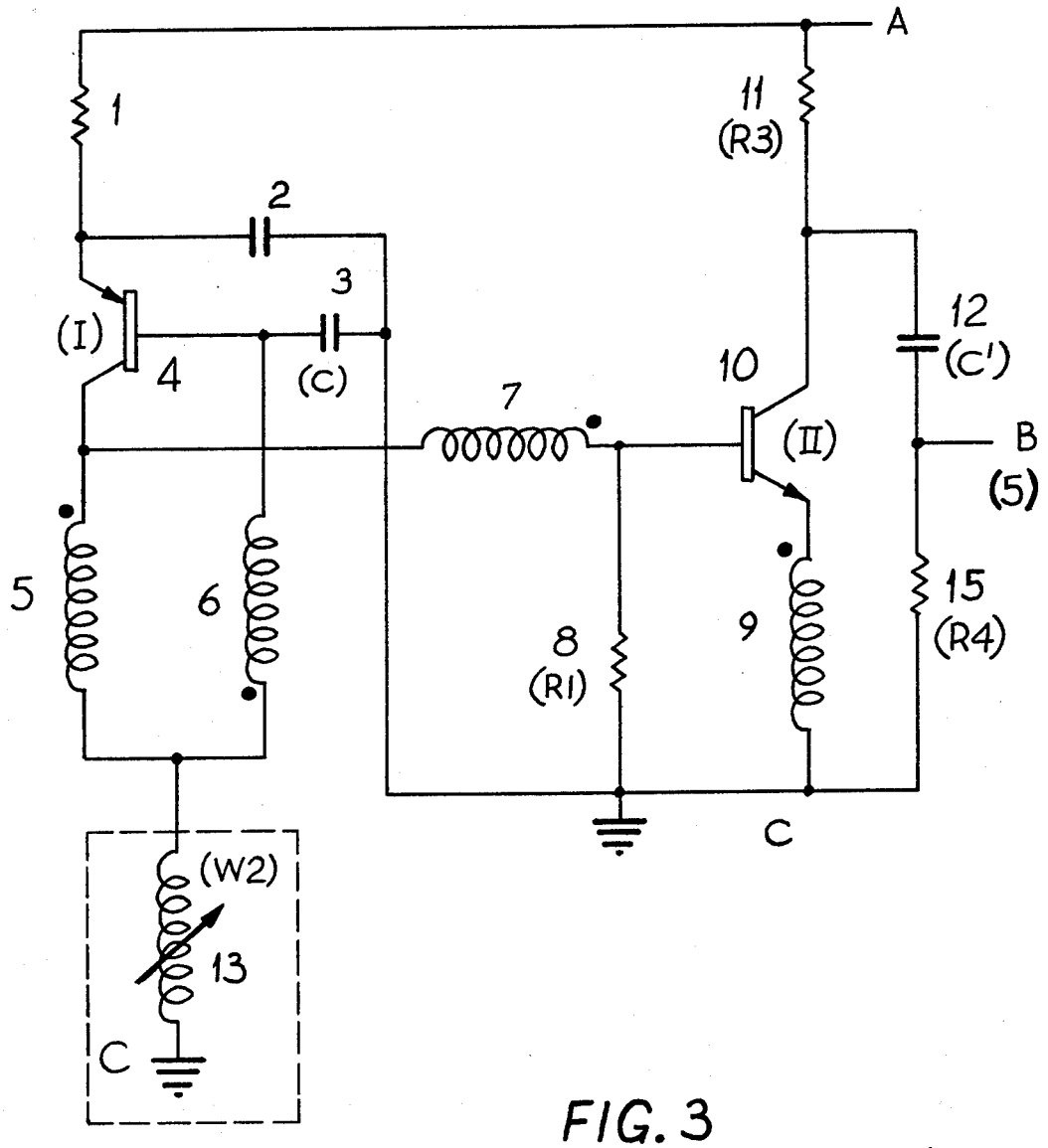
Figure 3:
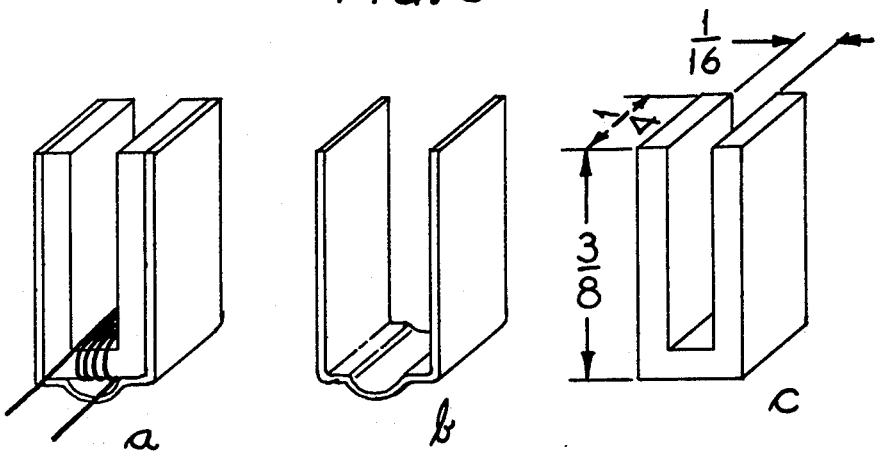

FIG. 2 is a schematic diagram of a portion of an ignition system showing another embodiment of this invention. The numbers and letters in parentheses indicate components with the same functions as the components so numbered in the specification and Figure of U.S Pat. No. 3,837,325. The comparison of (R1) and resistor 8 is for AC signals only. In the circuit of FIG. 2, the only component required to be located within the distributor housing is winding 13 shown enclosed in a dotted line to represent the distributor. The lead from this to the balance of the circuit may be several feet long. There are several advantages to this arrangement. Electronic components such as transistors, resistors, and capacitors which are part of an ignition circuit generally are required to be in a potted or encapsulated assembly for reliability around gasoline engines. The number of such encapsulated assemblies is thus reduced from two to one. Further advantage is that space is very limited in conventional distributors which have heretofore been designed primarily to house only breaker points and a condenser in addition, of course, to the high voltage distribution portion. There is very little space available therefore for installing electronic components or terminals for multiple or shielded wire. It has not been found necessary in units constructed thus far to shield the lead coming from said winding 13, although a twisted pair with ground being the other strand might be desirable in certain applications, particularly such as dual engine installations in marine applications. As in FIG. 1, point A is connected to the vehicle battery positive, point C is ground and vehicle battery negative and point B represents the output to the balance of the ignition system. Components 4 and 10 are amplifying devices shown respectively as PNP and NPN transistors which supply the required gain for this oscillator or pulse generator circuitry. As in FIG. 1, transistor 4 is biased slightly in the active region with the steady state collector emitter voltage equal to the base emitter saturation voltage. The current, of course, will vary with the voltage at point A and be determined primarily by resistor 1 which might have a typical value of a thousand ohms. 2 is a by-pass capacitor typically 0.1 MFD which effectively grounds the emitter of transistor 4 for AC signals. Capacitor 3 resonates with the inductance of windings 6 and 13 to determine the frequency of oscillation. Windings 5, 6, 7 and 9 are magnetically coupled. These may be wound on adjacent sections of a bobbin or alternately on a ferrite core with a large air gap. Coupling between windings 5 and 6 should approach unity, but this requirement does not apply between these and the other two windings where couplings around 50% have been found to be quite satisfactory. Resistor 8 serves to establish a known minimum load on the resonant circuit. Thus preventing unwanted paracitics or oscillations at frequencies well above those intended, and caused by either transistor 4 or 10. Its value is very non-critical. Satisfactory operation has been observed with values as low as 200 ohms and as high as infinity, normally the value would be between 500 and 10,000 ohms. Transistor 10 in the absence of oscillations is biased in the cut-off region as described in application Ser. No. 181,445. The gain, and therefore the power handled by device 10, increases rapidly once oscillations have begun, and the initial high current pulse through the output B and capacitor 12 is controlled primarily by transistor 10. Resistor 11, typically 10,000 ohms, controls the collector current available for transistor 10 and allows the charging of capacitor 12 through a circuit completed through resistor 15 to ground during intervals when transistor 10 is turned off. The criterion for oscillation of this circuit will now be described.

Assume windings 5 and 6 to be of an equal number of turns and either bi-filar wound or wound so closely together that the coupling is essentially unity and therefore the voltage across these two windings equal at every instant taking due regard for the phasing marks shown in the figure. While the DC bias on transistor 4 is quite similar to that in FIG. 1 transistor 6, there being a very low DC impedance from collector to base in both cases, the AC signal path is quite different. It has already been pointed out that the emitter of transistor 4 is effectively grounded by capacitor 2. Assume for a moment that winding 13 is short circuited. Any voltage appearing across winding 5 as a result of collector current, would appear directly across the base emitter junction in the direction to further increase the collector current variation that caused it, thus oscillation would certainly result, there being no negative feedback whatsoever in the circuit.

Now consider the situation with the short circuit just assumed across winding 13 removed, and winding 13 so constructed that the average of its minimum and maximum value, that is its value when the conductive portions of the controlling disc are fully in and fully out of between the pole pieces, equals the values of winding 5. Assume the vane at the position where the inductance of 13 equals the inductance of 5. Any AC collector current through device 4 will produce a voltage across winding 5 and an equal voltage across the equal inductance of winding 13. The voltage present across the input of transistor 4, that is from its base emitter junction, will be the sum of the voltages on windings 13 and 6, which in the case just described can be seen from the polarity marks on the windings to be zero. Since the AC component of voltage across capacitor 3 is therefore zero, negligible current will pass through winding 6. The signal tending to prevent oscillation (the negative feedback of the signal created across winding 13) is just balanced by the signal tending to produce oscillation (the positive feedback signal across the equal inductor 5). Therefore a slight decrease in the value of 13 corresponding to a movement of the vane further out of the gap in the inductor will certainly cause oscillation and any further increase in the value of 13 corresponding to the further movement of the vane into the slot will certainly prevent oscillation. Careful examination of what has just been said and the figure will show some clear and very important differences between the theory of operation of this and previous circuits proposed for similar applications. Windings 13 and 5 (and therefore B) are not coupled magnetically, but are coupled by the passage through both of almost the same AC current (the collector emitter loop current of transistor 4.)

In FIG. 2, oscillation is determined by the ratio of the value of two inductors 5 and 13. The loss or equivalent resistive component of these windings has very little to do with the criterion for oscillation. In circuitry such as is shown in U.S. Pat. No. 3,316,448, James T. Hardin and U.S. Pat. No. 3,277,340, N. A. Jukes et al, oscillation is controlled primarily by the relationship between the resistive component of the inductors involved and either another fixed resistor in the circuit or the inherent losses in other components in the circuit. This generally requires very careful selection of components and in most cases requires adjustment of at least one component value to compensate for the specific components installed in each individual system. In the Jukes patent, critical adjustment or selection is also required for the DC bias point on the transistor. Distinction should be noticed between this and the prior U.S. Pat. Nos. 3,395,685, 3,435,265, and 3,549,944. In those cases only a portion of the voltage produced across the winding of windings in the collector emitter loop, on a given core structure, was used or usuable to produce negative feedback, and thus prevent unwanted oscillations. Windings 7 and 9 tend to produce a more sharply defined output pulse and insure the formation of an adequate pulse even at very slow rates of rotation of the vane degrees. In some applications they might be eliminated with the collector of transistor 4 connected directly to the base of transistor 10, and the emitter of 10 directly to ground. Transistor 10 would then serve primarily as an amplifier instead of part of a two transistor oscillator since power from its collector emitter loop could no longer be coupled from winding 9 back through the other windings to the bases of both transistors.

FIG. 3*a* shows a prefered construction of inductor 13. 3*b* shows a thin metal strip placed around the core and winding to act as an eddy current shield and thus increase the ratio of maximum to minimum inductance. 3*c* shows the core for winding 13. Typical dimensions are shown. Ferrite would be one suitable material. Typical inductance reduction caused by the insertion of a 0.02 inch thick brass vane was found to be 2 to 1. The dimensions and values given are for the purpose of aiding understanding of circuit operation and are not intended as restrictions. Further modifications will also occur to those skilled in this art, and all such being considered to fall within the spirit and scope of the invention as defined in the appended claims.

What is claimed is:

1. In an ignition system a gated oscillator containing a variable magnetic circuit for controlling said oscillator, an amplifying device to supply the gain required for oscillation, a source of power for said amplifying device, a bias network for supplying power from said power source to establish the steady-state operating point of said amplifying device such that variations in the voltage of said source of power vary the steady-state current through but has little effect on the steady-state voltage across said amplifying device and means to produce ignition pulses corresponding to the gating of said gated oscillator.

2. The system of claim 1 wherein said amplifying device is a transistor and said bias network contains a low DC impedance from the collector to the base of said transistor.

3. The system of claim 2 wherein said bias network contains a high DC impedance between the output terminals of said amplifying device and said power source.

* * * * *